United States Patent [19]

Sayles

[11] 3,953,258

[45] Apr. 27, 1976

[54] POLYNITROAMINE OXIDIZER CONTAINING PROPELLANT

[75] Inventor: David C. Sayles, Huntsville, Ala.

[73] Assignee: The United States of America as represented by the Secretary of the Army, Washington, D.C.

[22] Filed: July 6, 1970

[21] Appl. No.: 56,016

[52] U.S. Cl. ..... 149/19.3; 149/19.6; 149/19.91; 149/92

[51] Int. Cl.[2] ..... C06B 45/10

[58] Field of Search ..... 149/92, 19, 19.3, 19.91, 149/19.6

[56] References Cited

UNITED STATES PATENTS

| | | | |
|---|---|---|---|
| 3,006,957 | 10/1961 | Murray et al. | 149/92 X |
| 3,117,044 | 1/1964 | Sauer | 149/92 X |
| 3,389,026 | 6/1968 | Johnson | 149/92 X |
| 3,476,622 | 11/1969 | Harada et al. | 149/19 |

*Primary Examiner*—Edward A. Miller
*Attorney, Agent, or Firm*—Nathan Edelberg; Robert P. Gibson; Jack W. Voigt

[57] ABSTRACT

Bis(trinitroethyl)nitroamine, $O_2N.N[CH_2.C(NO_2)_3]_2$, (BTNEN), is used as an oxidizer in smokeless propellants. BTNEN can be used as a replacement for cyclotetramethylene tetranitramine (HMX) or cyclotetramethylene trinitramine, (RDX) in smokeless propellant compositions. Ready ignitability is ensured when BTNEN is used in hybrid grains. A higher performance results when BTNEN is substituted for HMX or RDX in a propellant formulation. The propellant composition employing BTNEN as oxidizer has lower tendency to afterburning since it is a more effective oxidizer and as a result thereof, there are few combustibles in the exhaust products.

4 Claims, No Drawings

POLYNITROAMINE OXIDIZER CONTAINING PROPELLANT

DEDICATORY CLAUSE

The invention described herein may be manufactured, used, and licensed by or for the Government for governmental purposes without the payment to me of any royalties thereon.

BACKGROUND OF THE INVENTION

High energy smokeless type propellants containing both ammonium perchlorate (inorganic oxidizer) and HMX and RDX (organic oxidizers) have been utilized.

Acrylic prepolymers (e.g., ethyl acrylate-acrylic acid copolymers) have been used in high energy NF propellants containing ammonium perchlorate and aluminum, and in non-aluminized low signature propellants with HMX or RDX as the oxidizer. The techniques for prepolymers preparation and characterization and for propellant preparation are well understood.

HMX and/or RDX have been utilized as oxidizers in heat resistant granulated propellant compositions as disclosed in U.S. Pat. No. 3,386,868.

HMX and/or RDX have been utilized in smokeless propellant compositions. The use of these organic oxidizers has greatly reduced the amount of smoke in the exhaust gases from the burning propellant.

There exists a need for improvement of the ballistic parameters of smokeless type propellants.

Therefore, an object of this invention is to provide an oxidizer for use in propellant compositions whereby increased performance and desirable effects to the ballistic parameters are obtained.

Another object of this invention is to provide propellant formulations which have a lower tendency to afterburning.

A further object of this invention is to provide oxidizer for use in smokeless propellants of the NF type as a replacement for the organic oxidizers, HMX and/or RDX.

SUMMARY OF THE INVENTION

Bis(trinitroethyl)nitroamine, $O_2N.N[CH_2.C(NO_2)_3]_2$, (BTNEN) is used as an oxidizer to replace the oxidizers HMX or RDX in an NF propellant formulation to provide increased performance and to provide desirable effects on the ballistic parameters. In addition to BTNEN, the NF propellant formulation of this invention contain ethyl acrylate-acrylic acid copolymer, 1,2,3-tris[1,2-bis(difluoroamino)ethoxy]propane, (TVOPA), ammonium perchlorate, additive of carbon black, and dicyclo diepoxy carboxylate curing agent. BTNEN as an oxidizer in propellants is more effective than either of the oxidizers, HMX or RDX as evidenced by the higher content of $CO_2$ and $H_2O$ and lower content of CO and $H_2$ in the exhaust products from the burning propellant containing BTNEN as compared to a control propellant containing HMX or RDX. Thus, a propellant composition based on BTNEN has much lower tendency to afterburning.

DESCRIPTION OF THE PREFERRED EMBODIMENTS

A typical propellant of this invention uses a binder comprised of a copolymer of ethyl acrylate-acrylic acid constituted of about 95 parts ethyl acrylate to about 5 parts acrylic acid in amounts of about 4 to about 10 percent by weight of the propellant composition. The copolymer of ethyl acrylate-acrylic acid is representative of many other types of acrylate-acrylic acid copolymers (e.g., methyl, propyl, butyl acrylate etc. -acrylic acid copolymers) which are generally constituted of from about 4 to about 10 parts acrylic acid. The specified type copolymer is used in combination with 1,2,3-tris[1,2-bis(difluoramino)ethoxy]propane, (TVOPA), a high energy NF plasticizer. TVOPA is used in amounts from about 15 to about 30 percent by weight of the propellant composition. Dicyclo diepoxy carboxylate is used as the curative, stabilizer, and cross-linking agent in amounts from about 0.5 to about 2.0 percent by weight of the propellant composition. The oxidizer BTNEN of this invention is preferably used in amounts from about 40 to about 60 percent by weight of said propellant composition and is used in combination with ammonium perchlorate (AP) since AP is an effective means for lowering the pressure exponent. AP also provides a means for varying the burning rate of the propellant by varying the particle size of the AP. AP content may vary from about 10 to about 30 percent by weight of the propellant composition. Carbon black is used in the propellant composition in amounts of from about 0.5 to about 1.0 percent by weight of the propellant composition.

BTNEN is a polynitronitramine which may be synthesized by reacting trinitroethanol with ammonia to form bis(trinitro)ethylamine. Bis(trinitro)ethylamine is nitrated with nitric/sulfuric acids to form the polynitronitramine, bis(trinitro)ethylnitramine. The more recent prior art work related to research with bis(trinitro)ethylnitramine is summarized in U.S. Navy Report, NAV ORD 1764, 16 Jan 51, F. Taylor. The compound, bis(trinitro)ethylnitramine, was first synthesized in Germany before the turn of the present century (exact date is uncertain).

TVOPA is a difluoramino plasticizer which is used as a plasticizer and is cured to form the energetic binder of the propellant system. TVOPA is prepared by reacting tris(vinoxy)propane (prepared in accordance with U.S. Pat. No. 2,969,400) with tetrafluorohydrazine. TVOPA contains two high energy difluoramino groups, $NF_2$, in each of the three vinoxy groups of the starting compound, tris(vinoxy)propane. The reaction of tetrafluorohydrazine with tris(vinoxy)propane to form TVOPA is conducted under pressure in the range of 500 mm of mercury up to about 600 psig and temperature ranges of about 0° to 120°C. The reaction is conducted in the presence of an inert volatile organic solvent, preferably one that is a suitable solvent for both TVOPA as well as the reactant. Aromatic and aliphatic hydrocarbons, chlorinated hydrocarbons, ethers and ketones may be employed as the solvent. Typical solvents include diethyl ether, dipropyl ether, pentane, hexane, chloroform, carbon tetrachloride, methylene chloride, benzene, toluene, xylene, and acetone.

The benefits from using BTNEN as a replacement for HMX or RDX are readily discernible when one reviews the data set forth in Table I hereinbelow.

TABLE I

THE EFFECT OF THE REPLACEMENT OF HMX WITH BTNEN IN PROPELLANTS

| INGREDIENT | COMPOSITION A | COMPOSITION B |
|---|---|---|
| Ethyl Acrylate-Acrylic Acid (95:5) | 4.6 | 4.6 |
| 1,2,3-tris[1,2-bis(difluoroamino)ethoxy]- | | |

TABLE I-continued

THE EFFECT OF THE REPLACEMENT OF HMX WITH BTNEN IN PROPELLANTS

| INGREDIENT | COMPOSITION A | B |
|---|---|---|
| propane | 25.6 | 25.6 |
| Tetramethylene tetranitroamine (HMX) | 48.6 | 0.0 |
| AP | 19.2 | 19.2 |
| Dicyclo diepoxy carboxylate | 1.5 | 1.5 |
| Carbon black | 0.5 | 0.5 |
| BTNEN | 0.0 | 48.6 |
| **BALLISTIC PROPERTIES** | | |
| Ispt (lbf-sec/lbm) | 250.1 | 264.9 |
| C* (fps) | 5152 | 5310 |
| $C_f$ | 1.562 | 1.605 |
| $T_c$ (°K) | 2910 | 3356 |
| **COMPOSITION OF EXHAUST PRODUCTS (MOLES/100 gm)** | | |
| $CH_4$ | 0.001 | 0.0 |
| CO | 25.0 | 16.3 |
| $CO_2$ | 0.87 | 19.8 |
| HCl | 3.7 | 4.5 |
| HF | 14.8 | 17.5 |
| $H_2$ | 18.3 | 3.9 |
| $H_2O$ | 9.0 | 17.7 |
| $NH_3$ | 0.001 | 0.0 |
| $N_2$ | 20.5 | 20.3 |

As set forth in Table I, the data indicates that the substitution of BTNEN for HMX results in the following effects on the ballistic parameters of propellant B:

1. Increases the specific impulse value by 14.8 lbf-sec/lbm which is a very significant improvement in performance.

2. Increases the characteristic exhaust velocity by 158 fps.

3. Increases the thrust coefficient by 33.

4. Increases the propellant flame temperature by 446°K.

5. Reduces the amount of afterburning in the rocket exhaust (plume combustion).

BTNEN may also be used in hybrid grains as part of the composition and when so used the ignitability is ensured since the available oxygen content is in excess amount of that required for combustion of BTNEN. HMX and RDX are considered monopropellants, viewed with respect to the amount of oxygen present, since the oxygen content of these compounds is about equal to that present in a typical monopropellant. Excess oxygen is lacking for use by the other propellant ingredients.

BTNEN is not limited to use in acrylate-acrylic acid — TVOPA compositions. BTNEN is usable in various types of double-base propellants as a replacement for HMX or RDX and in composite propellants based on a crosslinked hydroxyl-terminated polyester. The processing of propellants using BTNEN can be readily accomplished by established procedures pertinent to the particular propellant system wherein used.

I claim:

1. A propellant composition comprising the oxidizer bis(trinitroethyl)nitroamine; a binder comprised of ethyl acrylate-acrylic acid copolymer in combination with 1,2,3-tris[1,2-bis(difluoramino)epoxy] propane; and dicyclo diepoxy carboxylate curing agent.

2. The propellant composition of claim 1 wherein said propellant composition contains an additional oxidizer ammonium perchlorate and the additive, carbon black.

3. The propellant composition of claim 2 wherein said copolymer is constituted of from about 90 to about 96 parts ethyl acrylate and from about 4 to about 10 parts acrylic acid, said copolymer being used in amounts from about 4 to about 10 percent by weight of said propellant composition; said 1,2,3-tris[1,2-bis(difluoramino)ethoxy]propane is used in amounts from about 15 to about 30 percent by weight of said propellant composition; said dicyclo diepoxy carboxylate is used in amounts from about 0.5 to about 2.0 percent by weight of said propellant composition; said oxidizer ammonium perchlorate is used in amounts from about 10 to about 30 percent by weight of said propellant composition; said carbon black is used in amounts from about 0.5 to about 1.0 percent by weight of said propellant composition; and said oxidizer bis(trinitroethyl)-nitroamine is used in amounts from about 40 to about 60 percent by weight of said propellant composition.

4. The propellant composition of claim 3 wherein said copolymer is used in an amount of about 4.6 percent by weight of said propellant composition; said 1,2,3-tris[1,2-bis(difluoramino)ethoxy]propane is used in an amount of about 25.6 percent by weight of said propellant composition; said dicyclo diepoxy carboxylate is used in an amount of about 1.5 percent by weight of said propellant composition; said oxidizer ammonium perchlorate is used in an amount of about 19.2 percent by weight of said propellant composition; said carbon black is used in an amount of about 0.5 percent by weight of said propellant composition; and said oxidizer bis(trinitroethyl)nitroamine is used in an amount of about 48.6 percent by weight of said propellant composition.

* * * * *